US005611519A

United States Patent [19]

Garcia

[11] Patent Number: 5,611,519

[45] Date of Patent: Mar. 18, 1997

[54] FASTENER REMOVING TOOL

[76] Inventor: Rodolfo Garcia, 6144 Ensign Ave., North Hollywood, Calif. 91606

[21] Appl. No.: 467,957

[22] Filed: Jun. 6, 1995

[51] Int. Cl.[6] ..... B25C 11/00

[52] U.S. Cl. ..... 254/22; 81/426.5

[58] Field of Search ..... 81/424.5, 426.5, 81/418, 44; 254/18, 21, 25, 23, 29, 22; 29/268

[56] References Cited

U.S. PATENT DOCUMENTS

| | | | |
|---|---|---|---|
| 97,399 | 11/1869 | Holmes | 81/418 |
| 181,175 | 8/1876 | Huntoon | 81/418 |
| 219,504 | 9/1879 | Qbrist . | |
| 258,920 | 6/1882 | Hayden | 254/22 |
| 380,331 | 4/1888 | Leslie . | |
| 713,808 | 11/1902 | Shallenberger . | |
| 832,541 | 10/1906 | Dodge . | |
| 1,073,802 | 9/1913 | Fulghum | 81/424.5 |
| 1,289,761 | 12/1918 | Hodges . | |
| 1,506,675 | 8/1924 | Seppmann | 81/426.5 |
| 1,668,474 | 5/1928 | Wells . | |
| 1,802,666 | 11/1929 | Mueller . | |
| 2,239,108 | 4/1941 | Lindemann | 81/426.5 |
| 3,664,346 | 5/1972 | Dunn | 81/424.5 |
| 4,658,489 | 4/1987 | Johnston . | |

*Primary Examiner*—Robert C. Watson
*Attorney, Agent, or Firm*—Robert Louis Finkel

[57] ABSTRACT

A pliers-like hand tool for removing headed plastic fasteners having a stem releasably anchored below a surface incorporates a pair of pivotably joined, wedge-shaped jaws and their associated handles. A spring positioned between the handles maintains the jaws open in readiness for insertion under the head of a fastener. A bend in the jaws provides a fulcrum for applying leverage against the underside of the head of the fastener. A series of graduated opposed elongated grooves formed in the edges of the jaws and oriented normal to the top surface of the jaws allow the user to apply controlled gripping force to the stem of the fastener in the region, adjacent the head, most prone to fracture by bending, thereby effectively immobilizing the stem with respect to the head of the fastener and minimizing bending of the stem in the sensitive region. In addition to thus greatly reducing the likelihood of fracture, by distributing the prying force over a relatively large area of the stem's surface, the orientation and shape of the grooves minimize damage to the surface of the stem which would otherwise render the fastener unusable.

8 Claims, 1 Drawing Sheet

FIG. 1
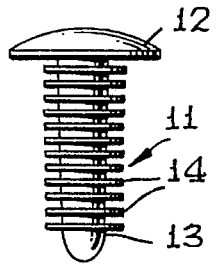
FIG. 2
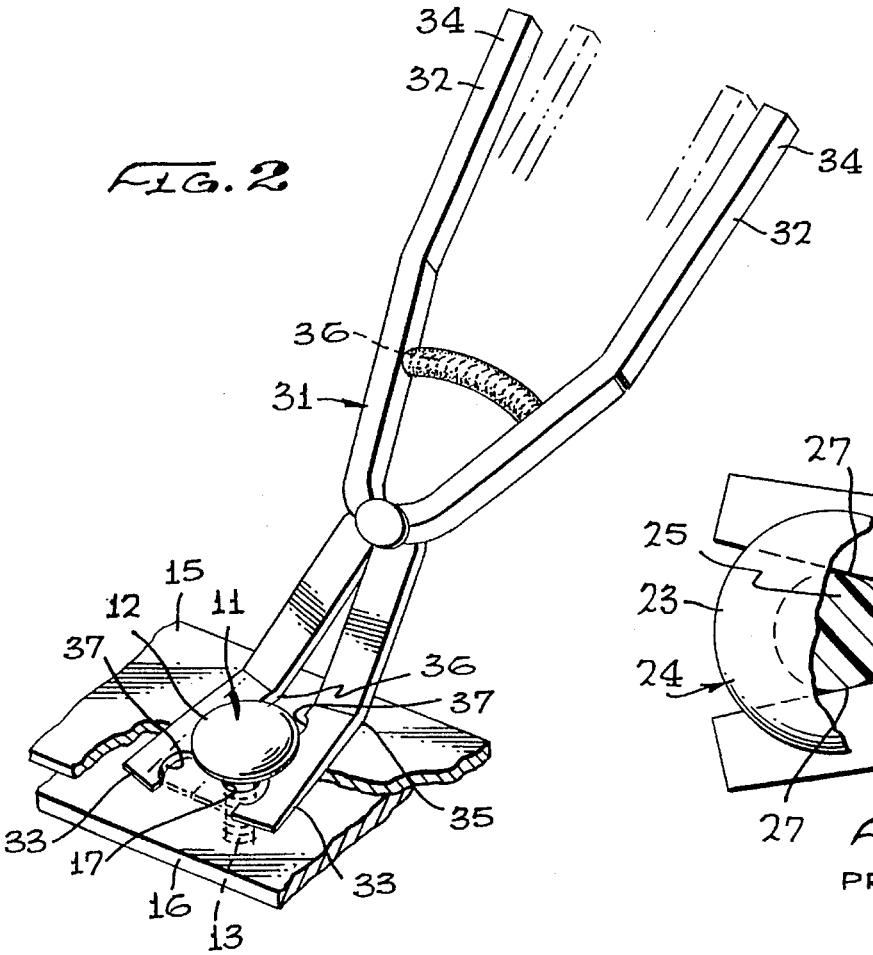
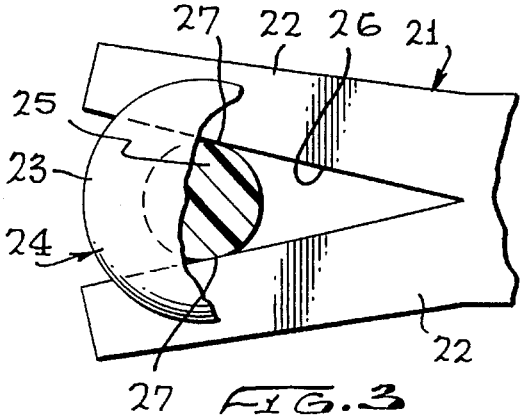
FIG. 3
PRIOR ART
FIG. 4
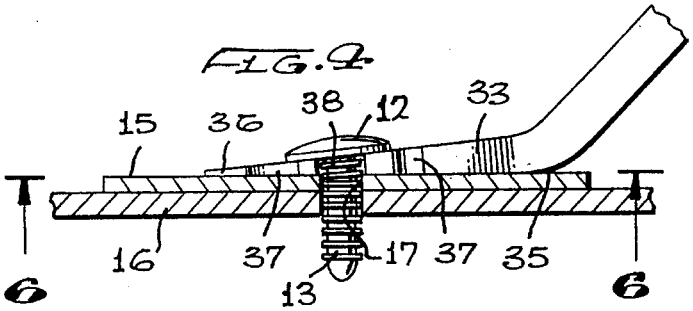
FIG. 6
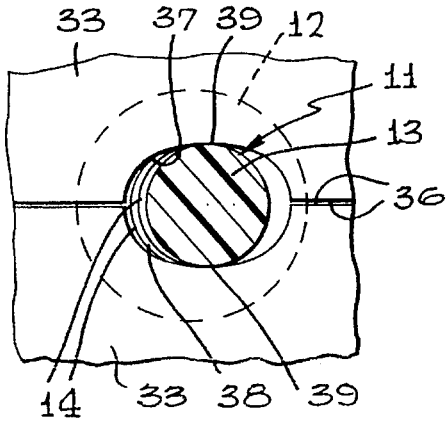
FIG. 5
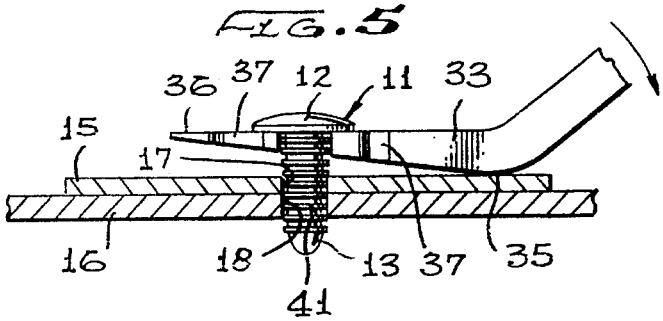

FASTENER REMOVING TOOL

BACKGROUND OF THE INVENTION

1. Field of the Invention

This invention relates to hand tools, and more particularly to prying tools of the type used in removing headed fasteners, such as automobile panel fasteners and the like.

2. Prior Art

In modern automobiles, non-structural components, such as feature strips, decorative panels, and insulating mats, are commonly held in place by means of large-headed, plastic fasteners having serrated stems adapted for insertion into retaining openings or clips in adjacent structural members. Removal or replacement of a component is easily accomplished by merely prying the fastener out of its retainer. If undamaged, these fasteners can be used and reused a number of times.

Although no special tool is required, and indeed, virtually any screw driver, knife blade, pry-bar, diagonal cutter, or pair of pliers that can be wedged under the head of the fastener will serve the purpose, a widely recognized need exists for a specialized fastener removing tool for the automobile manufacture, repair, and upholstery trades.

A variety of prying tools have been developed in response to this need. Generally they are of two types. One type incorporates fixed "claws" or pivotably connected jaws adapted to apply leverage between the underside of the fastener head and the underlying surface. The second employs pliers-like means for gripping the stem of the fastener and applies the prying force to the stem rather than to the head of the fastener. U.S. Pat. Nos. 713,808 and 4,658,489 are illustrative of the first type of tool. Several tools of the second type are described in U.S. Pat. Nos. 832,541, 1,289,761, and 1,802,666.

Both types of prior art tools suffer from major deficiencies: In those of the first type, the prying leverage applied against the underside of the fastener head imposes substantial shear and torsional forces on and within the stem. These forces are focused primarily in the region of the stem immediately adjacent the head. Generally, internal stresses and structural anomalies induced during the fabrication of the fastener make this region particularly susceptible to such forces. Unless extreme care is taken in applying leverage to the head of the fastener, and frequently, despite the exercise of such care, the resulting abrupt shearing or bending of the stem causes the fastener to fail, leaving the mechanic with the frustrating, time-consuming task of removing the broken stem and searching for the lost head. Even if the fastener remains in tact, in most instances the prying claws or jaws of these tools leave the serrated stem badly marred and unusable.

Tools of the second type, which grip the stem, are difficult to use without cutting or at least scoring the shaft, rendering the fastener unusable or nearly certain to fail in future use.

OBJECTS OF THE INVENTION

Viewed against this background, one object of the subject invention is to provide an improved fastener removing tool that overcomes the deficiencies inherent in prior art tools.

Another object is to provide an improved fastener removing tool that incorporates means for gripping and reenforcing the stem of the fastener in the region adjacent the head while prying force is applied directly to the head of the fastener.

An additional object is to provide a tool of this type in which the gripping force is applied to a relatively long segment of the fastener in order effectively to minimize the local shear and torsional forces acting on the stem.

A still further object is to provide in a tool of this type gripping means which minimize the likelihood of cutting, scoring, or marring the stem.

A more particular object is to provide a tool of this type that can be used for removing fasteners of various sizes and shapes.

Other objects will become apparent from the following summary of the invention and detailed description of its preferred embodiments.

SUMMARY OF THE INVENTION

The subject invention contemplates a pliers-like hand tool comprising a pair of rigid, elongated, pivotably joined members defining a pair of articulated wedge-shaped jaws and their associated handles. A bend in the jaws serves as a fulcrum for providing leverage between the handles and the jaws.

Typically, the insertion of a pair of open, tapered jaws between the head of a serrated fastener and the adjacent surface of an underlying attachment structure causes the head to ride up the jaws' top surface, drawing a segment of the stem straddled by the jaws outwardly of the adjacent surface. This camming action tends to impart two bends to the exposed portion of the stem, one in the region adjacent the underside of the head, and the second in the region adjacent the underlying surface. The amount of bending in each region is a function of a number of factors, such as the slope of the top surface, the resilience, ductility, and malleability of the stem material, the coefficients of friction of the several components, and the retentive strength of the attachment mechanism. Generally, both regions of the stem are able to withstand the shear and torsional forces associated with the initial camming action. Further, excessive bending in either region is likely to cause the stem to fail.

To prevent this, the jaws of the subject tool are provided with elongated grooves (elongated lengthwise of the jaws) in their confronting edges. Preferably, the orientation of the grooves is normal to the top surface of the jaws. When the tool handles are squeezed to close the jaws, the orientation and elongated shape of the grooves serve to apply controlled gripping force to opposite sides of the entire exposed segment of the stem, bent portions included, immobilizing the exposed segment of the stem with respect to the top surface of the jaws. Since the head of the fastener is firmly seated on the top surface of the jaws, as long as the jaws retain their grip on the initially exposed segment of the stem that segment of the stem is effectively immobilized with respect to the head of the fastener as well. In this condition, leverage applied to the jaws will cause the head and the adjacent segment of the stem to rotate about the fulcrum as a rigid unit, the prying force being borne equally by the head and the segment of the stem gripped by the jaws. Rotation of the jaws around the fulcrum during the remainder of the extraction process may impose shear and torsional forces on the stem. However, those forces will have little, if any, structural impact on the region of the stem adjacent the head of the fastener. Most, if not all, further bending of the stem will take place in regions more remote from the fastener head and less susceptible to shear and torsion.

In addition to thus minimizing the likelihood of failure of the stem, the provision of elongated grooves in the facing edges of the jaws serves the further advantage of distributing the gripping force exerted by the jaws symmetrically over a relatively large area of the exposed segment of the stem, thereby greatly increasing the likelihood the fastener can be removed without damage to the surface of the stem and reused.

For a fuller understanding of the invention, its operation, and its advantages, reference is made to the following detailed description of the embodiment illustrated in the accompanying drawings, in which:

BRIEF DESCRIPTION OF THE DRAWINGS

FIG. 1 is a side view of a typical automotive panel fastener;

FIG. 2 is a fragmentary top perspective view illustrating a fastener removing tool in accordance with the subject invention partially inserted under the head of a fastener securing a decorative panel to a support member in an automobile, with the fastener removing tool shown gripping the fastener in phantom;

FIG. 3 is a fragmentary, partially cut-away, top plan view illustrating a typical prior art fastener remover prying a fastener from an underlying support member;

FIG. 4 is an enlarged, fragmentary, side view of one of the substantially identical confronting side faces of the jaws of the fastener removing tool of FIG. 2 inserted under the head of a fastener at the beginning of the removal operation;

FIG. 5 is a view of the fastener removing tool of FIG. 4 at a later stage of the removal operation; and FIG. 6 is an enlarged, fragmentary, bottom plan view of the fastener removing tool and fastener of FIG. 3, taken along the line 6—6.

Wherever practicable, the same numeral is used to identify identical or substantially similar features appearing in the several figures.

DETAILED DESCRIPTION OF THE PREFERRED EMBODIMENTS

Referring to FIG. 1, a typical automobile panel fastener 11 is injection molded of resilient plastic material in one piece, and includes a large head 12 and an elongated, generally cylindrical stem 13 having serrations 14 on its surface. Fasteners of this type exist in a variety of other forms and materials. By way of example, multi-piece units, having tapered and untapered stems, using resilient and mechanical detents in lieu of the previously mentioned serrations, and made of metal, composite, and hybrid materials rather than molded plastics, are well known. Although not mentioned with particularity in this specification, it will be understood that the subject invention is adaptable for removal of such fasteners as well.

As seen in FIG. 2, a conventional decorative panel 15 is mounted to a convenient underlying support structure 16 by passing the stem 13 of a fastener 11 through an opening 17 located in panel 15 in registry with a retainer, for example a hole, 18 provided in supporting structure 16, and inserting stem 13 into the retainer 18. In the assembly process, light force applied to the head 12 of fastener 11 snugs the preformed panel 15 against structure 16 and thrusts stem 13 into the retainer 18 where it is held fast by serrations 14. The fastener 11 is readily removable by prying stem 13 free of retainer 18, and if not damaged, can be reused.

FIG. 3 illustrates a typical prior art hand tool 21 used for this purpose. Commonly, such tools incorporate one or more sets of fixed jaws 22 adapted for insertion under the head 23 of a fastener 24 to pry the stem 25 out of its retainer (not shown). As will be noted, unless care is taken to avoid contacting stem 25 with jaws 22, the edges 26 of jaws 22 tend to mar the surface of stem 25 at their points of contact with its surface 27, often to a degree that renders the fastener unusable. However, avoiding this danger creates something of a dilemma for the user: If the jaws are allowed to touch only the underside of head 23, the strain on the fastener is frequently greater than the stem 25 can withstand, and the stem parts. In some installations, the only way to prevent this is to accept the risk of defacing the stem in trade for being able to remove the fastener in one piece. The subject invention avoids both horns of this dilemma.

Referring to FIGS. 2, 4, and 5, a preferred embodiment of the invention is a pliers-like hand tool 31 comprising a pair of elongated rigid members 32 pivotably joined to define a pair of laterally opposed, wedge-shaped jaws 33 and their associated handles 34. Jaws 33 are substantially mirror images of one another, having coplanar top and bottom surfaces which taper to a thin tip. A bend in jaws 33 defines a fulcrum 35 for applying leverage between handles 34 and jaws 33 when the tool is seated on a surface, such as the face of panel 15, and jaws 33 are closed.

Advantageously, resilient means, such as compressed spring 36, are interposed between handles 34 to maintain jaws 33 open in readiness for use.

The confronting side faces 36 of jaws 33 are provided with a graduated series of corresponding elongated, that is, non-cylindrical grooves 37. For reasons to be explained, the grooves 37 are oriented normally of the jaws' top surfaces. Grooves 37 are conveniently configured and sized to receive, and when the jaws 33 are closed, to grip the stems of typical fasteners of varying diameters. Preferably, the largest grooves (those adapted for the largest and presumably the longest fasteners) are closest to the tip, i.e., farthest from the fulcrum 35.

As best seen in FIGS. 2 and 4, the first step in the use of tool 31 for removing a fastener 11, the insertion of open jaws 33 under the head 12 of fastener 11 astraddle stem 13, pries a segment of stem 13 outwardly of panel 15. As the head 12 rides up the jaws' top surface, the tilting of head 12 imparts a bend to stem 13 in the region where the head and stem are joined. When the stem 13 is aligned with the grooves 37 best suited to its size and shape, handles 34 are grasped with sufficient force to effect a firm grip on the exposed segment 38 of stem 13.

The form of the grooves 37 plays an important part in the effective operation of the device. A pair of grooves 37 longer (lengthwise of jaws 33) than the diameter of the stem 13 will accept the entire length of the exposed segment 38 of stem 13. A pair of cylindrical grooves of the diameter of the stem 13 could not accommodate the bent stem without subjecting it to further shear and torsional forces and potential superficial damage. Additionally, as best seen by comparing FIG. 6 with FIG. 3, prior art jaws 22 without grooves, or with cylindrical grooves (not shown), apply gripping force to a stem 25 along narrow axial lines of contact 21. The subject invention's jaws 33 with elongated grooves 37 apply the same force to a region 39 comprising a substantially longer segment 38 and a substantially greater surface area of a similar stem 13, thereby minimizing the potential for overstressing the stem or marring its surface.

Returning to FIG. 5, with head 12 seated on the top surface of jaws 33 and stem 13 gripped firmly by the walls of grooves 37, leverage transmitted through fulcrum 35 resting on panel 15 allows the user to extract the remainder of stem 13 from the retainer in support structure 16 with ease. It will be noted that as leverage is exerted, the effect of the immobilization of head 12 and initially exposed segment 38 of stem 13 is to bring segment 38 and the, segment 41 of stem 13 following segment 38 into substantial axial alignment, thereby further reducing the shear and torsional forces acting on the stem 13.

The utility and advantages afforded by the subject invention will be readily apparent from the foregoing description. It should be understood, however, that although the invention has been described in terms of the specific constructions shown in the drawings, it is not to be construed as limited to those embodiments. They are to be regarded as illustrative rather than restrictive. This specification is intended to encompass any and all variations of the examples chosen for purposes of the disclosure, which do not depart from the spirit and scope of the following claims.

What is claimed is:

1. A pliers-like prying tool for removing a fastener having a head and a depending stem releasably anchored below an adjacent surface, said tool comprising:

two members pivotably connected to define a pair of opposed jaws with their associated handles and an intermediate fulcrum; said jaws having tapered, generally coplanar top and bottom surfaces for wedging insertion between the head of a fastener and an adjacent underlying surface and for applying prying force against the head of the fastener in response to leverage applied to the handles, and having confronting side faces; and an arcuate groove formed in the side face of one of the jaws, said groove being elongated lengthwise of the jaws and disposed normal to the top surface of the jaw, whereby said groove grips an arcuate region of a segment of the stem of a fastener seated in said groove in response to grasping force applied to the handles and thereby effectively immobilizes the segment of the stem with respect to the head of the fastener.

2. A tool in accordance with claim 1, wherein said groove is untapered.

3. A tool in accordance with claim 2, comprising a plurality of such arcuate grooves of graduated dimensions for receiving the stems of fasteners of various sizes.

4. A tool in accordance with claim 1, comprising a second arcuate groove formed in the side face of the other of the Jaws in registry and coextensive with the first said groove, said second groove being elongated lengthwise of the jaws and disposed normal to the top surface of its associated jaw.

5. A tool in accordance with claim 4, wherein said second groove is untapered.

6. A tool in accordance with claim 5, comprising a plurality of such arcuate grooves of graduated dimensions for receiving the stems of fasteners of various sizes.

7. A tool in accordance with claim 5, further comprising a spring engaging said members and mounted to exert a pivoting force urging the jaws apart.

8. A tool in accordance with claim 5, further comprising a spring engaging said members and mounted to exert a pivoting force urging the jaws apart.

* * * * *